US011573590B1

(12) United States Patent
Huang

(10) Patent No.: US 11,573,590 B1
(45) Date of Patent: Feb. 7, 2023

(54) BUTTON STRUCTURE

(71) Applicant: Cheng Uei Precision Industry Co., LTD., New Taipei (TW)

(72) Inventor: Che-Hung Huang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 17/744,719

(22) Filed: May 15, 2022

(30) Foreign Application Priority Data

Jul. 27, 2021 (CN) ..... 202121724231.9

(51) Int. Cl.
*G05G 1/04* (2006.01)
*G05G 5/05* (2006.01)

(52) U.S. Cl.
CPC ..... *G05G 1/04* (2013.01); *G05G 5/05* (2013.01)

(58) Field of Classification Search
None
See application file for complete search history.

(56) References Cited

U.S. PATENT DOCUMENTS 8,961,311 B2 * 2/2015 Lee ..... A63F 13/24 463/37
9,017,168 B2 * 4/2015 Lee ..... A63F 13/24 463/37
2015/0135888 A1 * 5/2015 Bernardele ..... B62M 25/08 74/523

* cited by examiner

*Primary Examiner* — Vicky A Johnson
(74) *Attorney, Agent, or Firm* — Cheng-Ju Chiang

(57) ABSTRACT

A button structure includes a first component, a second component, and a pressing element mounted on the second component. The first component has a first base portion. The first base portion protrudes outward to form at least one first extending portion. The at least one first extending portion protrudes inward to form a limiting portion. The second component has a second base portion. The second base portion protrudes rearward to form at least one second extending portion. The at least one first extending portion and the at least one second extending portion are connected by a pivoting assembly. The at least one second extending portion protrudes rearward to form a blocking portion. When the blocking portion is pivoted on the first component, the blocking portion is alternatively located to a bottom of the limiting portion and a top of the limiting portion.

19 Claims, 7 Drawing Sheets

BUTTON STRUCTURE

BACKGROUND OF THE INVENTION

1. Field of the Invention

The present invention generally relates to a button structure, and more particularly to a button structure that is able to retain a sufficient assembly space during an assembly process.

2. The Related Art

A conventional button structure includes many components, and a structure of each component is small, so it has more restrictions in assembly. The conventional button structure needs to meet a structural design which is convenient for each component to be assembled and to be pressed.

However, in the process of assembling the button structure, a positional relationship among the components of the button structure easily makes that some of the components are hardly assembled, or the button is hardly pressed correctly after assembly.

Therefore, it is necessary to provide an innovative button structure that is able to retain a sufficient assembly space during an assembly process to meet assembling requirements and use requirements.

SUMMARY OF THE INVENTION

An object of the present invention is to provide a button structure. The button structure includes a first component, a second component and a pressing element. The first component has a first base portion. At least one side of the first base portion protrudes outward to form at least one first extending portion. An inner side surface of the at least one first extending portion protrudes inward to form a limiting portion. The second component has a second base portion. At least one side of the second base portion protrudes rearward to form at least one second extending portion. The at least one second extending portion is located at one side of the at least one first extending portion. The at least one first extending portion and the at least one second extending portion are connected by a pivoting assembly. The pivoting assembly is flexible, so the at least one second extending portion is pivoted by the pivoting assembly. A free end of the at least one second extending portion protrudes rearward to form a blocking portion. The blocking portion is disposed corresponding to the limiting portion. When the blocking portion of the at least one second extending portion is pivoted on the first component, the blocking portion is alternatively located to a bottom of the limiting portion and a top of the limiting portion. The pressing element is mounted on the second component. When the second component and the pressing element are in an assembling position, the blocking portion is located to the bottom of the limiting portion, and a bottom of the second component is exposed outside, after the second component and the pressing element are assembled, the second component and the pressing element are pivoted downward to a pressing position, the blocking portion passes beyond a top surface of the limiting portion to make the blocking portion located at the top surface of the limiting portion. A rear end of the second component is wrapped in the first component. When the button structure is in the pressing position, the blocking portion is unable to move downward to pass the limiting portion, so that the pressing element and the second component are limited to maintain in the pressing position.

Another object of the present invention is to provide a button structure. The button structure includes a first component, a second component, a pivoting assembly and a pressing element. The first component has a first base portion. Two sides of the first base portion protrude outward to form two first extending portions. An inner side surface of one first extending portion protrudes inward to form a limiting portion. Two front ends of the two first extending portions have two first through holes transversely penetrating through the two first extending portions. The second component is pivoted on the first component. The second component has a second base portion. Two sides of the second base portion protrude rearward to form two second extending portions. The two second extending portions have two second through holes transversely penetrating through the two second extending portions. The two second extending portions are located between the two first extending portions. Two outer sides of the two second extending portions abut between two inner sides of the two first extending portions, respectively. A free end of one second extending portion protrudes rearward to form a blocking portion. The blocking portion is disposed corresponding to an inner surface of the limiting portion. When the blocking portion of the one second extending portion is pivoted on the first component, the blocking portion is alternatively located to a bottom of the limiting portion and a top of the limiting portion. The pivoting assembly includes a pivoting shaft and a torsion spring. The pivoting shaft passes through the two first through holes and the two second through holes, so the two first extending portions and the two second extending portions are connected by the pivoting shaft of the pivoting assembly. The pivoting assembly is flexible, and the pivoting shaft is rotatable, so each second extending portion is pivoted by the pivoting shaft of the pivoting assembly. The torsion spring is mounted around the pivoting shaft. The torsion spring is located between the two second extending portions. The pressing element is mounted on the second component. When the second component and the pressing element are in an assembling position, the blocking portion is located to the bottom of the limiting portion, and a bottom of the second component is exposed outside, after the second component and the pressing element are assembled, the second component and the pressing element are pivoted downward to a pressing position, the blocking portion passes beyond a top surface of the limiting portion to make the blocking portion located at the top surface of the limiting portion. A rear end of the second component is wrapped in the first component. When the button structure is in the pressing position, the blocking portion is unable to move downward to pass the limiting portion, so that the second component and the pressing element are limited to maintain in the pressing position.

Another object of the present invention is to provide a button structure. The button structure includes a first component, a second component, a pivoting assembly and a pressing element. The first component has a first base portion. Two sides of the first base portion protrude outward to form two first extending portions. An inner side surface of one first extending portion protrudes inward to form a limiting portion. Two front ends of the two first extending portions have two first through holes transversely penetrating through the two first extending portions. A front end of a middle of the first base portion protrudes frontward to form a stopping portion. The second component is pivoted on the first component. The second component has a second base portion. Two sides of the second base portion protrude rearward to form two second extending portions. The two second extending portions have two second through holes transversely penetrating through the two second extending portions. The two second extending portions are located between the two first extending portions. Two outer sides of the two second extending portions abut between two inner sides of the two first extending portions, respectively. A free end of one second extending portion protrudes rearward to form a blocking portion. The blocking portion is disposed corresponding to an inner surface of the limiting portion. When the blocking portion of the one second extending portion is pivoted on the first component, the blocking portion is alternatively located to a bottom of the limiting portion and a top of the limiting portion. The pivoting assembly includes a pivoting shaft and a torsion spring. The pivoting shaft passes through the two first through holes and the two second through holes, so the two first extending portions and the two second extending portions are connected by the pivoting shaft of the pivoting assembly. The pivoting assembly is flexible, and the pivoting shaft is rotatable, so each second extending portion is pivoted by the pivoting shaft of the pivoting assembly. The torsion spring is mounted around the pivoting shaft. The torsion spring is located between the two second extending portions. The pressing element is mounted on the second component. When the second component and the pressing element are in an assembling position, the blocking portion is located to the bottom of the limiting portion, and a bottom of the second component is exposed outside, after the second component and the pressing element are assembled, the second component and the pressing element are pivoted downward to a pressing position, the blocking portion passes beyond a top surface of the limiting portion to make the blocking portion located at the top surface of the limiting portion. When the button structure is in the pressing position, one end of the torsion spring abuts against lower surfaces of the two second extending portions, and the other end of the torsion spring abuts against a lower surface of the stopping portion, the blocking portion is unable to move downward to pass the limiting portion, so that the second component and the pressing element are limited to maintain in the pressing position.

As described above, before the button structure is assembled, the second component and the pressing element are in the assembling position, the blocking portion is disposed corresponding to the inner surface of the limiting portion, the blocking portion is located below the limiting portion, the first fixing hole and the second fixing hole are exposed outside for the user to fix the first fixing hole and the second fixing hole. After the button structure is assembled, a position of the pressing element is limited, the second component and the pressing element are pivoted to the pressing position. When the button structure is in the pressing position, the blocking portion passes beyond the limiting portion to make the blocking portion limited on the top surface of the limiting portion, the blocking portion is unable to move downward to pass the limiting portion, so that the blocking portion is unable to be located below the limiting portion, and the blocking portion is located at an outside of the limiting portion, the blocking portion of the second component and the pressing element are limited to maintain in the pressing position, the rear end of the second component is wrapped in the first component. As a result, the button structure is able to retain a sufficient assembly space during an assembly process.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
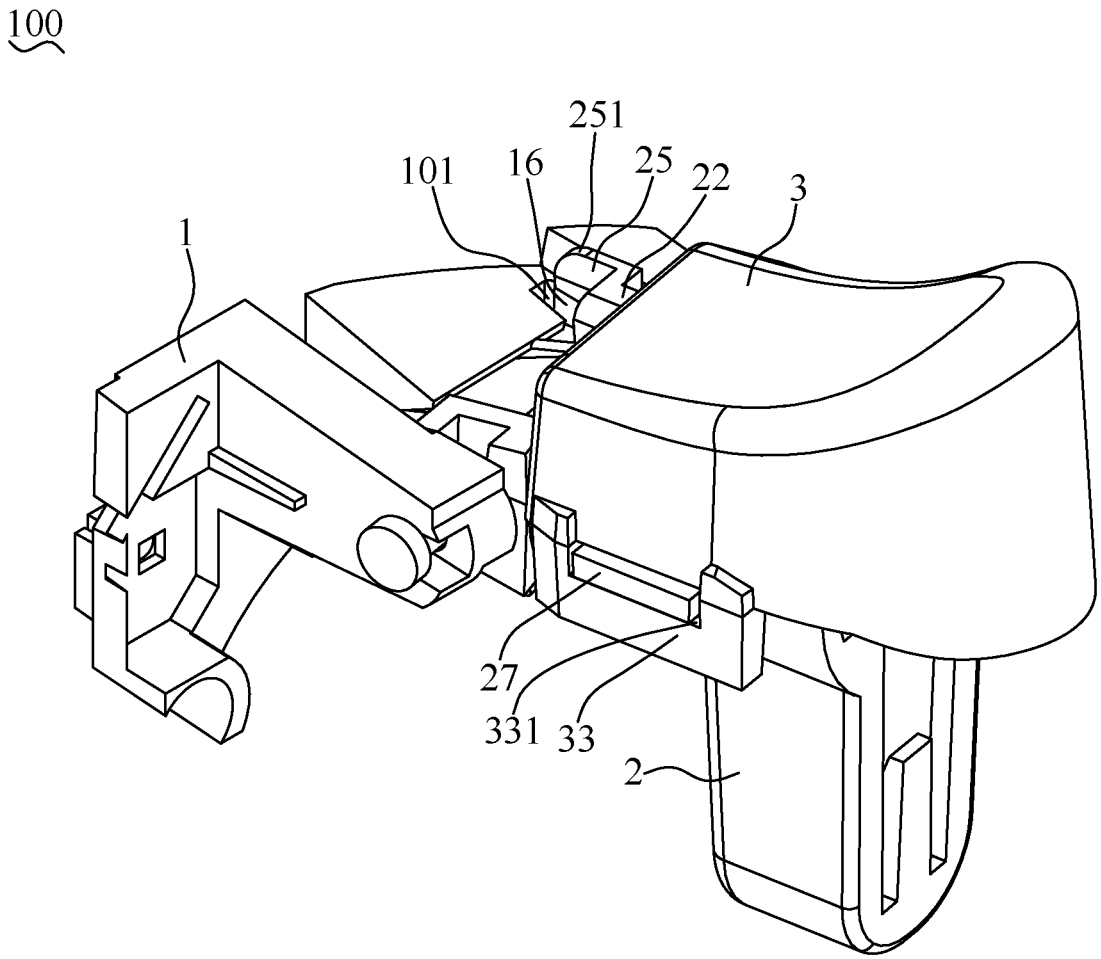
FIG. 1 is a perspective view of a button structure in accordance with the present invention.
Figure 2:
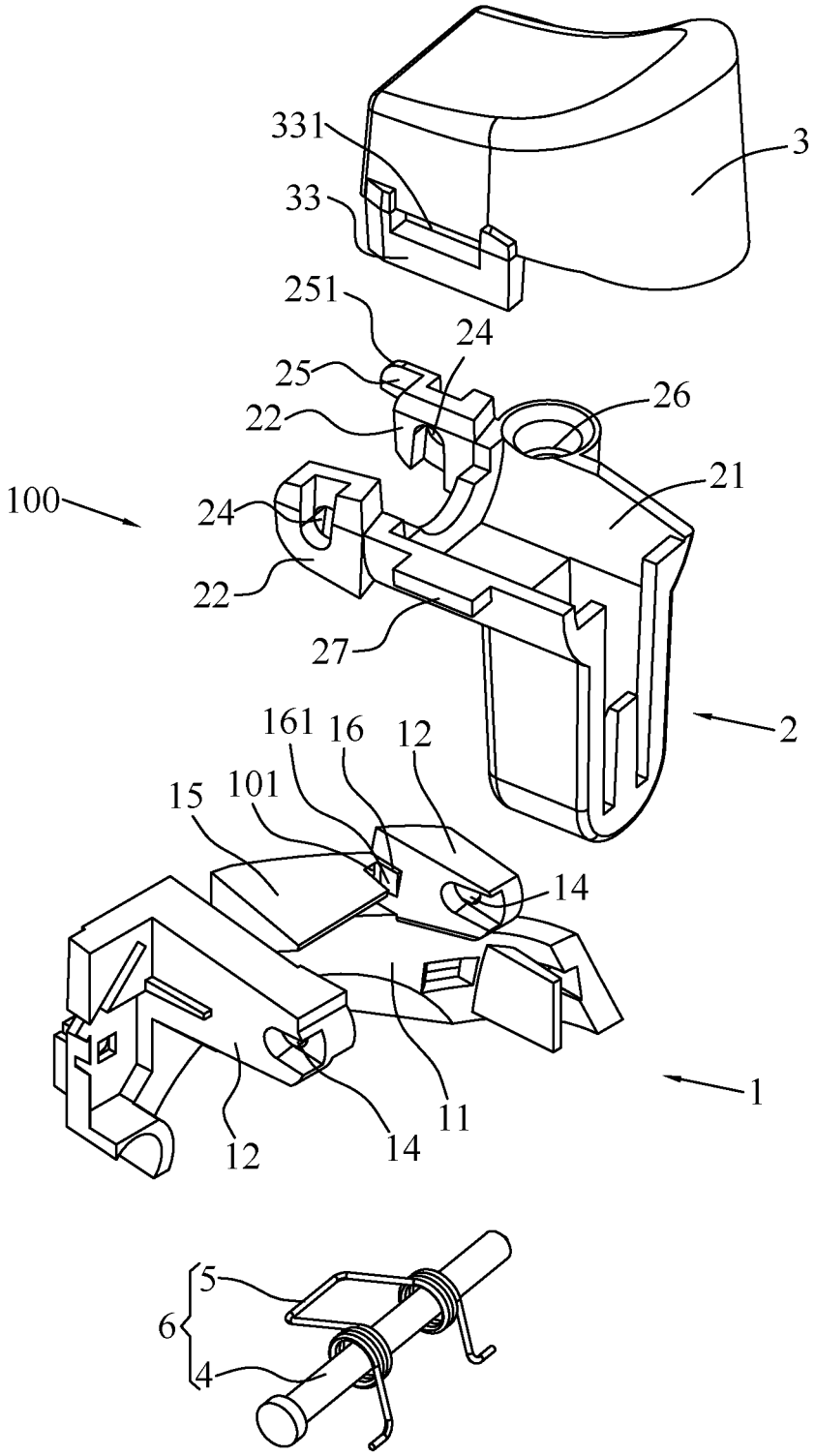
FIG. 2 is an exploded view of the button structure in accordance with the present invention.
Figure 3:
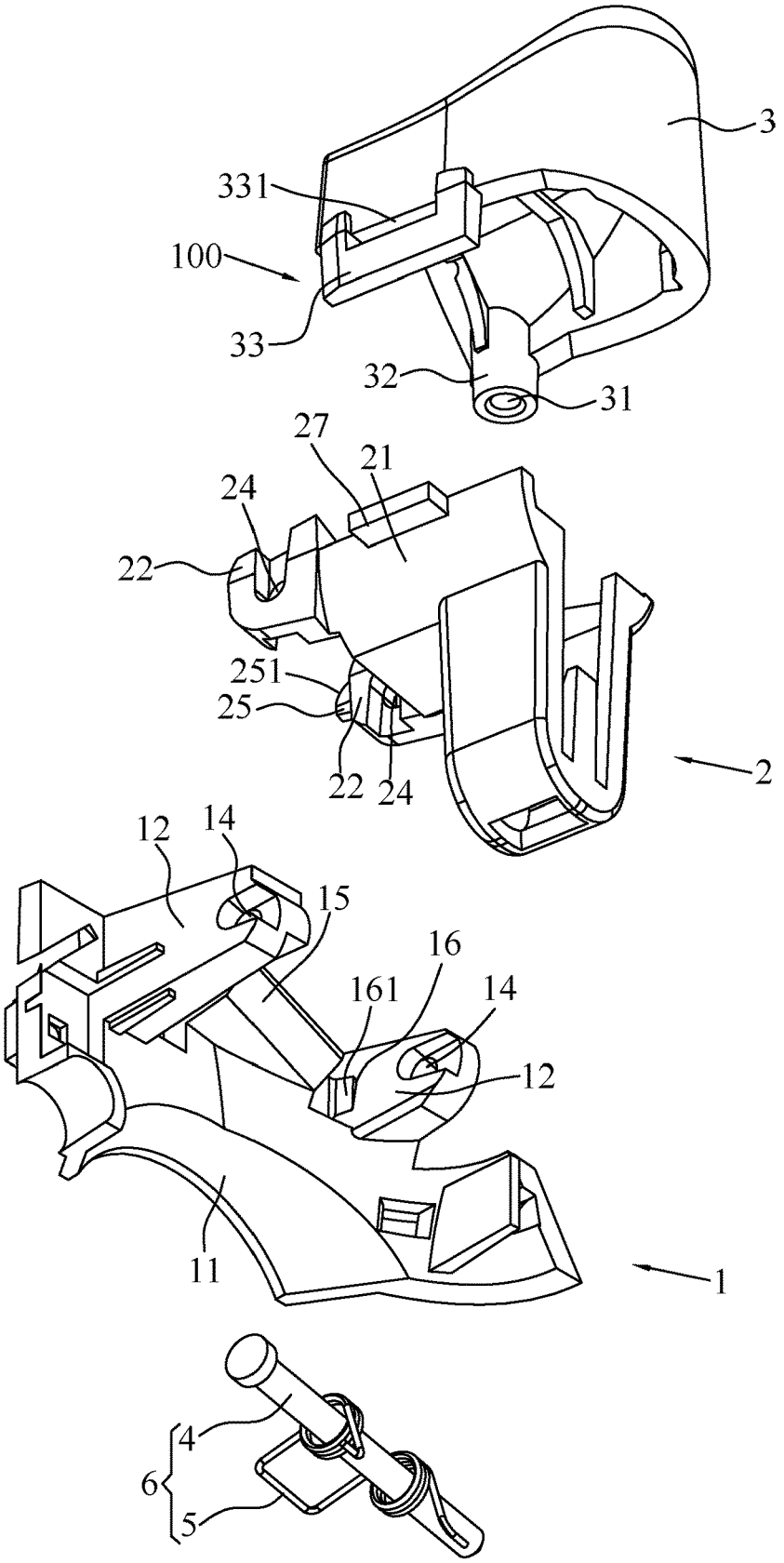
FIG. 3 is another exploded view of the button structure in accordance with the present invention.
Figure 4:
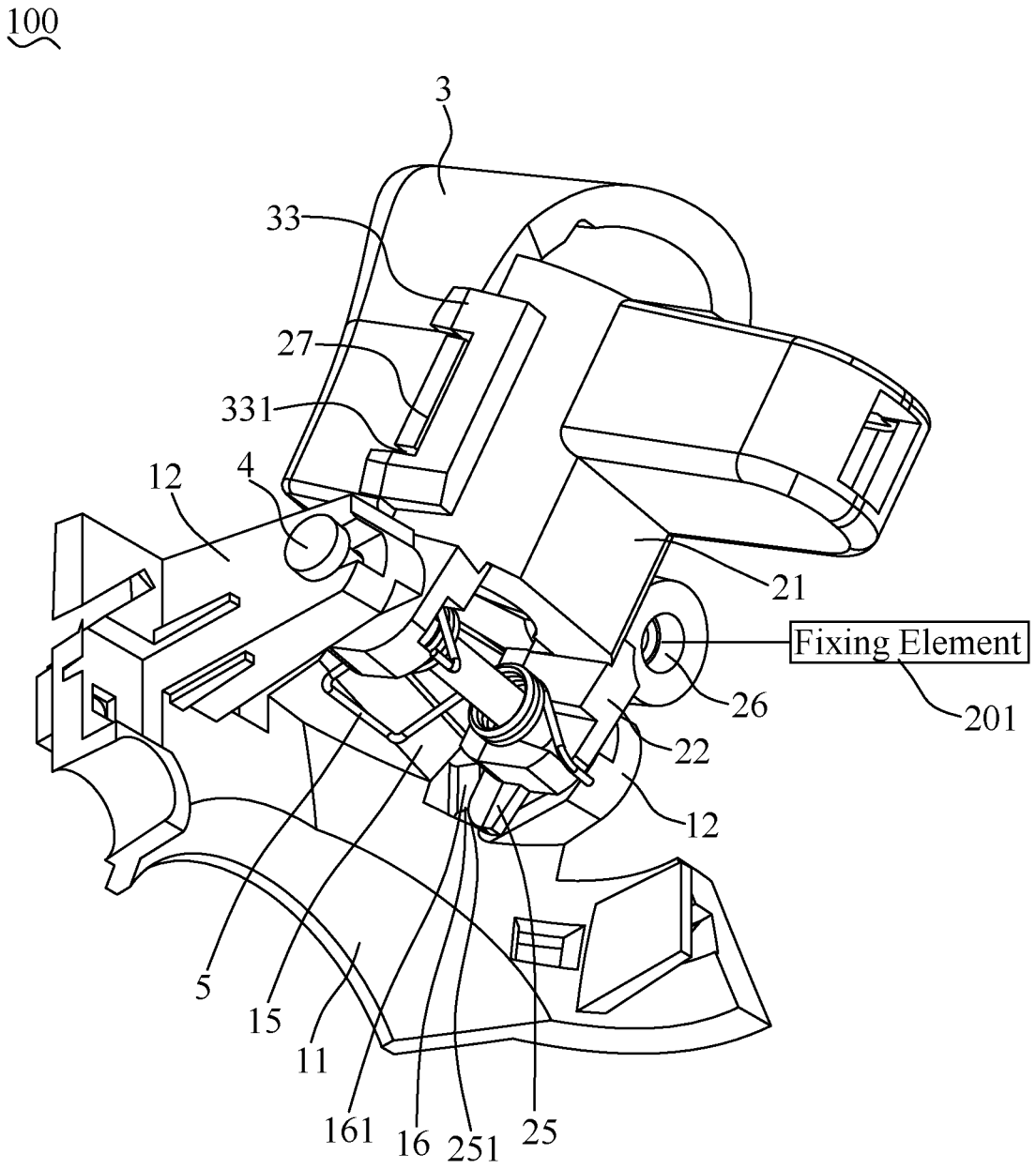
FIG. 4 is a perspective view of the button structure in accordance with the present invention, wherein the button structure is located at an assembling position.
Figure 5:
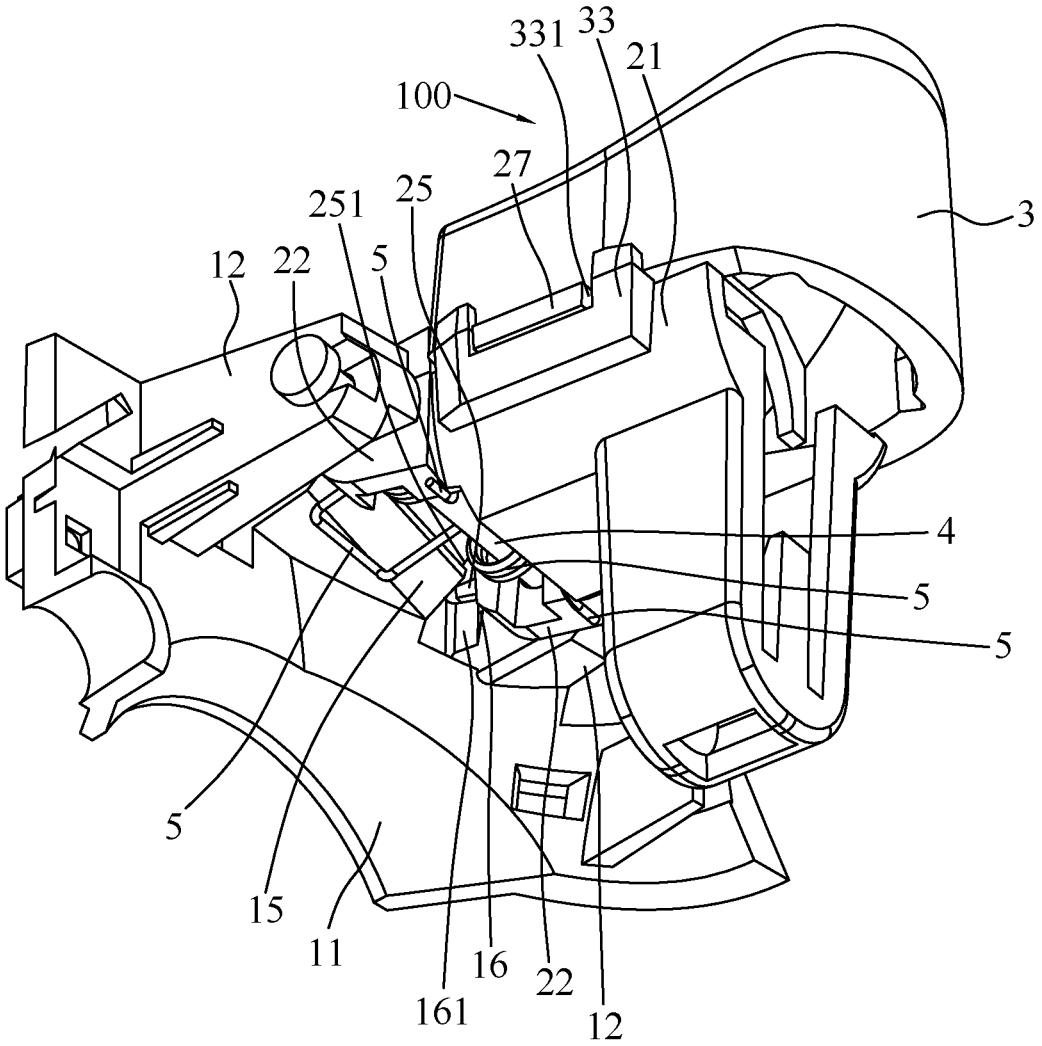
FIG. 5 is a perspective view of the button structure in accordance with the present invention, wherein the button structure is located at a pressing position.
Figure 6:
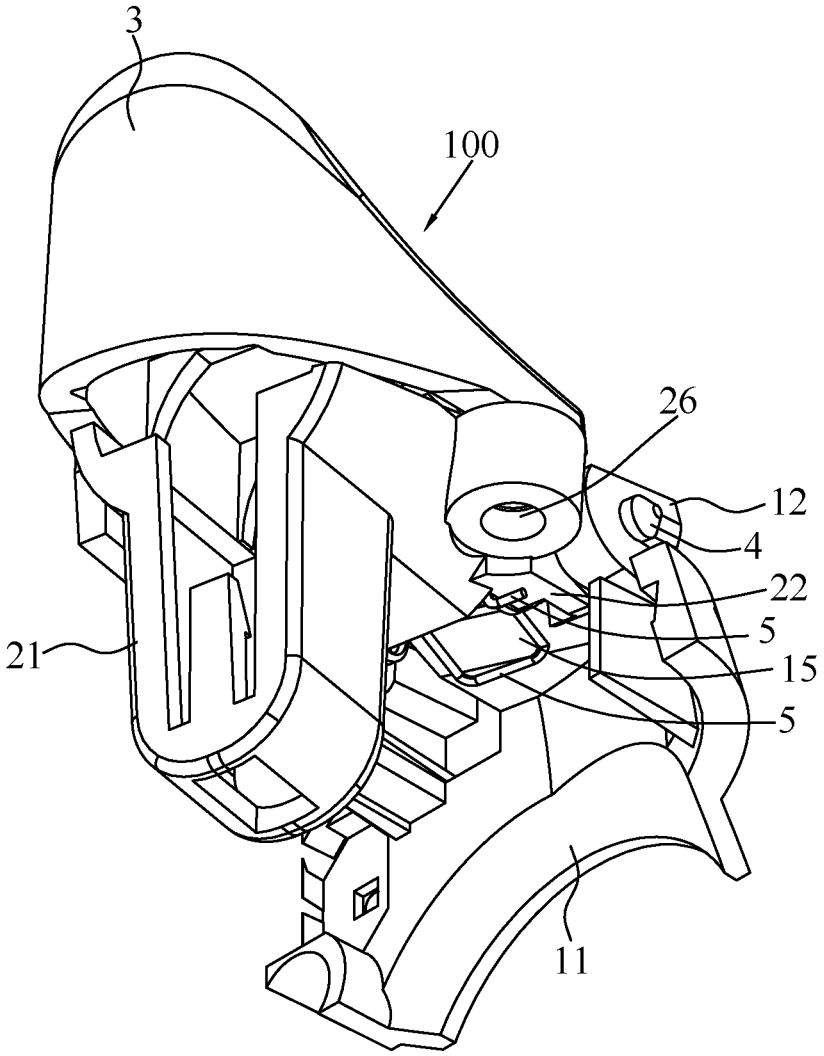
FIG. 6 is another perspective view of the button structure in accordance with the present invention, wherein the button structure is located at the pressing position.
Figure 7:
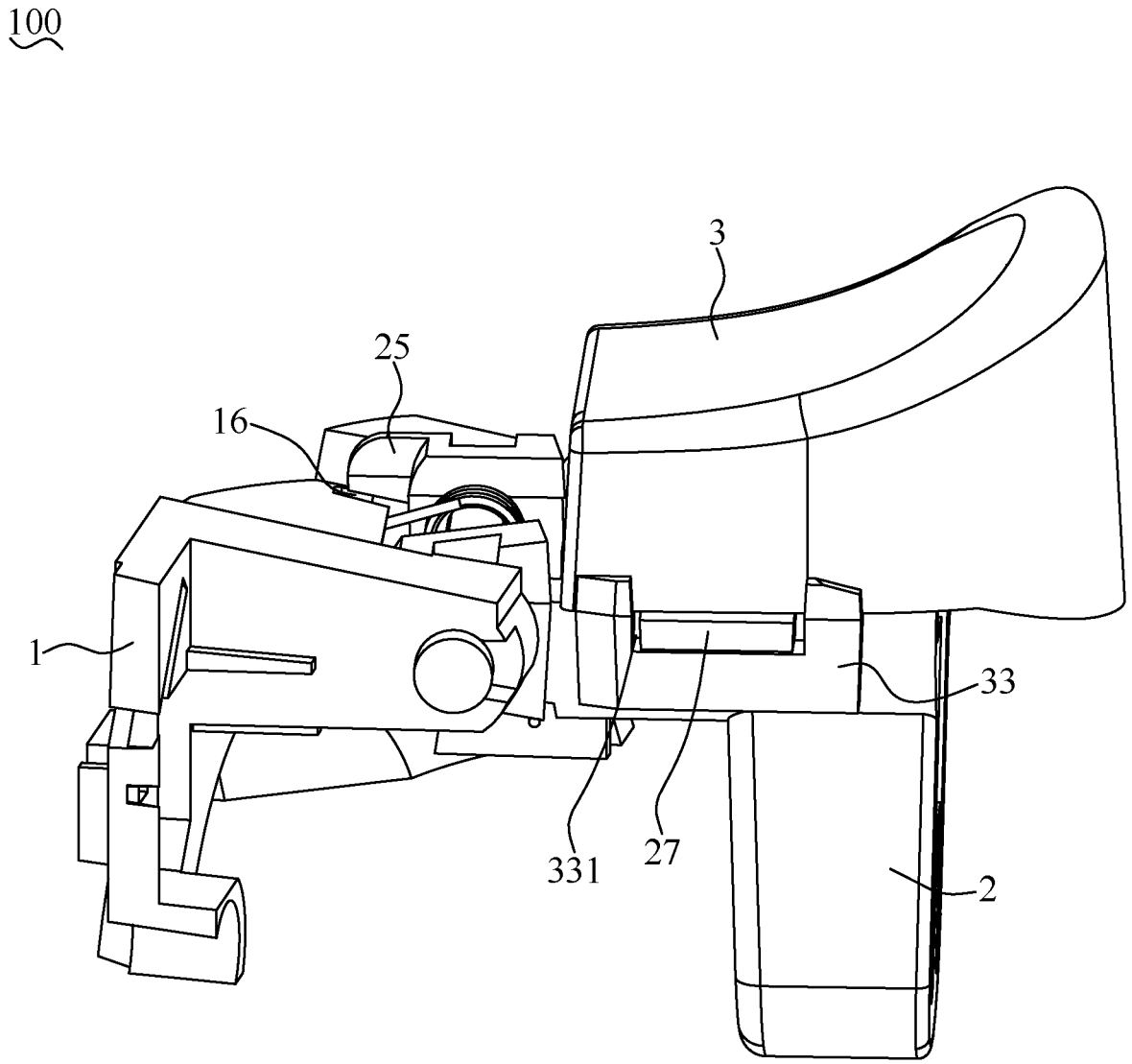
FIG. 7 is one more perspective view of the button structure in accordance with the present invention, wherein the button structure is located at the pressing position.

With reference to FIG. 1 to FIG. 3, a button structure 100 in accordance with the present invention is shown. The button structure 100 includes a first component 1, a second component 2 and a pressing element 3. The first component 1 is assembled with the second component 2. The pressing element 3 is assembled with the second component 2.

The first component 1 has a first base portion 11. At least one side of the first base portion 11 protrudes outward to form at least one first extending portion 12. A front end of the at least one first extending portion 12 has a first through hole 14 transversely penetrating through the at least one first extending portion 12. Two sides of the first base portion 11 protrude outward to form two first extending portions 12. Two front ends of the two first extending portions 12 have two first through holes 14 transversely penetrating through the two first extending portions 12. The two first through holes 14 are corresponding to each other. A front end of a middle of the first base portion 11 protrudes frontward to form a stopping portion 15. The stopping portion 15 is spaced from an inner side surface of one first extending portion 12 to form a sliding groove 101 between the stopping portion 15 and the inner side surface of the one first extending portion 12. The inner side surface of the at least one first extending portion 12 protrudes inward and towards the stopping portion 15 to form a limiting portion 16. The inner side surface of the one first extending portion 12 protrudes inward and towards the stopping portion 15 to form the limiting portion 16. The limiting portion 16 is located in the sliding groove 101. The limiting portion 16 is spaced from the stopping portion 15. An inner surface of the limiting portion 16 is an inclined surface 161. The inclined surface 161 is inclined outward and downward from top to bottom. A top surface of the limiting portion 16 slantwise extends inward and upward.

The second component 2 has a second base portion 21. At least one side of the second base portion 21 protrudes rearward to form at least one second extending portion 22. The at least one second extending portion 22 has a second through hole 24 transversely penetrating through the at least one second extending portion 22. The second through hole 24 is corresponding to the first through hole 14. The second through hole 24 is communicated with the first through hole 14. Two sides of the second base portion 21 protrude rearward to form two second extending portions 22. The two second extending portions 22 have two second through holes 24 transversely penetrating through the two second extending portions 22. The two second through holes 24 are corresponding to each other. The two second extending portions 22 are located between the two first extending portions 12. Two outer sides of the two second extending portions 22 abut between two inner sides of the two first extending portions 12, respectively. Each second through hole 24 is corresponding to one first through hole 14.

The button structure 100 further includes a pivoting assembly 6. The pivoting assembly 6 includes a pivoting shaft 4 and a torsion spring 5. The at least one second extending portion 22 is located at one side of the at least one first extending portion 12. The at least one first extending portion 12 and the at least one second extending portion 22 are connected by the pivoting assembly 6. The pivoting shaft 4 passes through the first through hole 14 and the second through hole 24. The pivoting assembly 6 is flexible, so the at least one second extending portion 22 is pivoted by the pivoting assembly 6. A free end of the at least one second extending portion 22 protrudes rearward to form a blocking portion 25. An inner surface of the blocking portion 25 tilts downward and inward, and then tilts downward and outward. The blocking portion 25 is disposed corresponding to the limiting portion 16. When the blocking portion 25 of the at least one second extending portion 22 is pivoted on the first component 1. The blocking portion 25 is alternatively located to a bottom of the limiting portion 16 and a top of the limiting portion 16.

The pivoting shaft 4 passes through the two first through holes 14 and the two second through holes 24, so the two first extending portions 12 and the two second extending portions 22 are connected by the pivoting shaft 4 of the pivoting assembly 6. The pivoting assembly 6 is flexible, and the pivoting shaft 4 is rotatable, so each second extending portion 22 of the second component 2 is pivoted by the pivoting shaft 4 of the pivoting assembly 6, and the second component 2 is pivoted on the first component 1. An outer side of the free end of one second extending portion 22 protrudes rearward to form the blocking portion 25. The blocking portion 25 is disposed corresponding to the inner surface of the limiting portion 16 which is the inclined surface 161. When the blocking portion 25 of the one second extending portion 22 of the second component 2 is pivoted on the first component 1, the blocking portion 25 is alternatively located to the bottom of the limiting portion 16 and the top of the limiting portion 16. An upper corner of a rear end of the blocking portion 25 is a rounded corner 251. A rear end of an upper surface of the blocking portion 25 is an arc shape. One side of the second base portion 21 has a first fixing hole 26 vertically penetrating through a top surface and a bottom surface of the second base portion 21. The other side of the second base portion 21 protrudes outward to form a locating block 27.

Referring to FIG. 1 to FIG. 7, the pressing element 3 is mounted on the second component 2. One side of a lower surface of the pressing element 3 protrudes downward to form a fixing pillar 32. The other side of the lower surface of the pressing element 3 protrudes downward to form a flank 33. A middle of the flank 33 defines a locating hole 331 transversely penetrating through the flank 33. A middle of the fixing pillar 32 is recessed inward to form a second fixing hole 31. The fixing pillar 32 is inserted into the first fixing hole 26 from a top of the first fixing hole 26. The second fixing hole 31 is corresponding to the first fixing hole 26. The torsion spring 5 is mounted around the pivoting shaft 4. The torsion spring 5 is located between the two second extending portions 22. When the button structure 100 is in a pressing position, one end of the torsion spring 5 abuts against a lower surface of the at least one second extending portion 22, and the other end of the torsion spring 5 abuts against a lower surface of the stopping portion 15.

The button structure 100 further includes a fixing element 201. The fixing element 201 is inserted into the first fixing hole 26 and the second fixing hole 31 from a bottom of the first fixing hole 26. The fixing element 201 is fixed in the first fixing hole 26 and the second fixing hole 31, and the locating block 27 is located in the locating hole 331, so that the pressing element 3 is fixed to the second component 2. Specifically, the fixing element 201 is a screw.

Referring to FIG. 1 to FIG. 4, when the button structure 100 proceeds with an assembling operation, the second component 2 and the pressing element 3 are pivoted to be in an assembling position, at the moment, a bottom of the second component 2 is exposed outside, the first fixing hole 26 of the second component 2 and the second fixing hole 31 of the pressing element 3 are exposed outside, the first fixing hole 26 of the second component 2 and the second fixing hole 31 of the pressing element 3 slantwise extend rearward and upward, the fixing element 201 is easily inserted into the first fixing hole 26 and the second fixing hole 31, so that the pressing element 3 is fixed to the second component 2, and the blocking portion 25 of the second component 2 is located to the bottom of the limiting portion 16. The one end of the torsion spring 5 is suspended in the air, and the other end of the torsion spring 5 abuts against the lower surface of the stopping portion 15.

With reference to FIG. 1 to FIG. 7, after the second component 2 and the pressing element 3 are assembled, the second component 2 and the pressing element 3 are fixed by virtue of the fixing element 201 being fixed in the first fixing hole 26 and the second fixing hole 31, the second component 2 and the pressing element 3 are pivoted downward to the pressing position. At the moment, the blocking portion 25 projects into the sliding groove 101, the rounded corner 251 of the blocking portion 25 moves upward and contacts with the inclined surface 161 of the limiting portion 16, along with the second component 2 and the pressing element 3 pivoting, the blocking portion 25 abuts against the inclined surface 161 of the limiting portion 16, the blocking portion 25 interferes with the inclined surface 161 of the limiting portion 16, the rounded corner 251 makes the blocking portion 25 to move upward along the inclined surface 161 of the limiting portion 16, the blocking portion 25 tilts upward and inward, and the blocking portion 25 accumulates a resilience force, so that the blocking portion 25 passes beyond the top surface of the limiting portion 16. After the blocking portion 25 passes beyond the top surface of the limiting portion 16, the blocking portion 25 returns to an initial state due to the resilience force, at the moment, the blocking portion 25 located at the top surface of the limiting portion 16. A rear end of the second component 2 is wrapped in the first component 1.

When the button structure 100 is in the pressing position, a bottom surface of the blocking portion 25 slantwise extends inward and upward. The bottom surface of the blocking portion 25 is parallel with the top surface of the limiting portion 16. The blocking portion 25 passes beyond the limiting portion 16 to make the blocking portion 25 located on the top surface of the limiting portion 16. An outer side of the bottom surface of the blocking portion 25 abuts against an inner side of the top surface of the limiting portion 16. An edge of the bottom surface of the blocking portion 25 is unrounded, the blocking portion 25 is unable to move downward to pass the limiting portion 16, so that the blocking portion 25 is unable to be located below the limiting portion 16, the blocking portion 25 is limited on the top surface of the limiting portion 16, and the blocking portion 25 is located at an outside of the limiting portion 16, the blocking portion 25 of the second component 2 and the pressing element 3 are limited to maintain in the pressing position. The one end of the torsion spring 5 abuts against the lower surfaces of the two second extending portions 22, and the other end of the torsion spring 5 abuts against the lower surface of the stopping portion 15.

The first fixing hole 26 and the second fixing hole 31 are surrounded by the first component 1, the second component 2 and the pressing element 3. The fixing element 201 in the first fixing hole 26 and the second fixing hole 31 is hardly disassembled or assembled.

When a user presses the pressing element 3, the pressing element 3 is pivoted downward, at the moment, the torsion spring 5 is deformed with a movement of the pressing element 3 and accumulates a resilient force. When the user releases the pressing element 3, the torsion spring 5 restores to a normal state, the resilient force pushes the first extending portion 12 of the first component 1 and the pressing element 3 back to original states. At the moment, the bottom surface of the blocking portion 25 of the second component 2 abuts against the top surface of the limiting portion 16, so that the second component 2 and the pressing element 3 are restrained in original states.

As described above, before the button structure 100 is assembled, the second component 2 and the pressing element 3 are in the assembling position, the blocking portion 25 is disposed corresponding to the inner surface of the limiting portion 16 which is the inclined surface 161, the blocking portion 25 is located below the limiting portion 16, the first fixing hole 26 and the second fixing hole 31 are exposed outside for the user to fix the first fixing hole 26 and the second fixing hole 31. After the button structure 100 is assembled, a position of the pressing element 3 is limited, the second component 2 and the pressing element 3 are pivoted to the pressing position. When the button structure 100 is in the pressing position, the blocking portion 25 passes beyond the limiting portion 16 to make the blocking portion 25 limited on the top surface of the limiting portion 16, the blocking portion 25 is unable to move downward to pass the limiting portion 16, so that the blocking portion 25 is unable to be located below the limiting portion 16, and the blocking portion 25 is located at the outside of the limiting portion 16, the blocking portion 25 of the second component 2 and the pressing element 3 are limited to maintain in the pressing position, the rear end of the second component 2 is wrapped in the first component 1. As a result, the button structure 100 is able to retain a sufficient assembly space during an assembly process.

What is claimed is:

1. A button structure, comprising:

a first component having a first base portion, at least one side of the first base portion protruding outward to form at least one first extending portion, an inner side surface of the at least one first extending portion protruding inward to form a limiting portion;

a second component having a second base portion, at least one side of the second base portion protruding rearward to form at least one second extending portion, the at least one second extending portion being located at one side of the at least one first extending portion, the at least one first extending portion and the at least one second extending portion being connected by a pivoting assembly, the pivoting assembly being flexible, so the at least one second extending portion being pivoted by the pivoting assembly, a free end of the at least one second extending portion protruding rearward to form a blocking portion, the blocking portion being disposed corresponding to the limiting portion, when the blocking portion of the at least one second extending portion is pivoted on the first component, the blocking portion being alternatively located to a bottom of the limiting portion and a top of the limiting portion; and a pressing element mounted on the second component;

wherein when the second component and the pressing element are in an assembling position, the blocking portion is located to the bottom of the limiting portion, and a bottom of the second component is exposed outside, after the second component and the pressing element are assembled, the second component and the pressing element are pivoted downward to a pressing position, the blocking portion passes beyond a top surface of the limiting portion to make the blocking portion located at the top surface of the limiting portion, a rear end of the second component is wrapped in the first component; and wherein when the button structure is in the pressing position, the blocking portion is unable to move downward to pass the limiting portion, so that the pressing element and the second component are limited to maintain in the pressing position.

2. The button structure as claimed in claim 1, wherein an inner surface of the limiting portion is an inclined surface, the inclined surface is inclined outward and downward from top to bottom.

3. The button structure as claimed in claim 1, wherein an upper corner of a rear end of the blocking portion is a rounded corner.

4. The button structure as claimed in claim 1, wherein one side of the second base portion has a first fixing hole vertically penetrating through a top surface and a bottom surface of the second base portion, one side of a lower surface of the pressing element protrudes downward to form a fixing pillar, a middle of the fixing pillar is recessed inward to form a second fixing hole, when the button structure proceeds with an assembling operation, the second component and the pressing element are pivoted to be in the assembling position, the first fixing hole and the second fixing hole are exposed outside, the first fixing hole and the second fixing hole slantwise extend rearward and upward, the fixing pillar is inserted into the first fixing hole from a top of the first fixing hole, the second fixing hole is corresponding to the first fixing hole, the button structure includes a fixing element, the fixing element is inserted into the first fixing hole and the second fixing hole from a bottom of the first fixing hole.

5. The button structure as claimed in claim 4, wherein the fixing element is a screw.

6. The button structure as claimed in claim 4, wherein the other side of the second base portion protrudes outward to form a locating block, the other side of the lower surface of the pressing element protrudes downward to form a flank, a middle of the flank defines a locating hole transversely penetrating through the flank, the locating block is located in the locating hole.

7. The button structure as claimed in claim 1, wherein a front end of a middle of the first base portion protrudes frontward to form a stopping portion, the pivoting assembly includes a pivoting shaft and a torsion spring, the torsion spring is mounted around the pivoting shaft, when the button structure is in the pressing position, one end of the torsion spring abuts against a lower surface of the at least one second extending portion, and the other end of the torsion spring abuts against a lower surface of the stopping portion.

8. The button structure as claimed in claim 1, wherein a front end of the at least one first extending portion has a first through hole transversely penetrating through the at least one first extending portion, the at least one second extending portion has a second through hole transversely penetrating through the at least one second extending portion, the second through hole is corresponding to the first through hole, the second through hole is communicated with the first through hole, the pivoting assembly includes a pivoting shaft, the pivoting shaft passes through the first through hole and the second through hole.

9. The button structure as claimed in claim 1, wherein two sides of the first base portion protrude outward to form two first extending portions, two sides of the second base portion protrude rearward to form two second extending portions, the two second extending portions are located between the two first extending portions, two outer sides of the two second extending portions abut between two inner sides of the two first extending portions, respectively.

10. The button structure as claimed in claim 9, wherein the inner side surface of one first extending portion protrudes inward to form the limiting portion, the free end of one second extending portion protrudes rearward to form the blocking portion, the blocking portion is disposed corresponding to an inner surface of the limiting portion.

11. The button structure as claimed in claim 9, wherein two front ends of the two first extending portions have two first through holes transversely penetrating through the two first extending portions, the two second extending portions have two second through holes transversely penetrating through the two second extending portions, the pivoting assembly includes a pivoting shaft and a torsion spring, the pivoting shaft passes through the two first through holes and the two second through holes, so the two first extending portions and the two second extending portions are connected by the pivoting shaft of the pivoting assembly.

12. The button structure as claimed in claim 11, wherein the pivoting shaft is rotatable, so each second extending portion is pivoted by the pivoting shaft.

13. The button structure as claimed in claim 11, wherein the torsion spring is mounted around the pivoting shaft, the torsion spring is located between the two second extending portions.

14. The button structure as claimed in claim 11, wherein a front end of a middle of the first base portion protrudes frontward to form a stopping portion, one end of the torsion spring abuts against lower surfaces of the two second extending portions, and the other end of the torsion spring abuts against a lower surface of the stopping portion.

15. A button structure, comprising:

a first component having a first base portion, two sides of the first base portion protruding outward to form two first extending portions, an inner side surface of one first extending portion protruding inward to form a limiting portion, two front ends of the two first extending portions having two first through holes transversely penetrating through the two first extending portions;

a second component pivoted on the first component, the second component having a second base portion, two sides of the second base portion protruding rearward to form two second extending portions, the two second extending portions having two second through holes transversely penetrating through the two second extending portions, the two second extending portions being located between the two first extending portions, two outer sides of the two second extending portions abutting between two inner sides of the two first extending portions, respectively, a free end of one second extending portion protruding rearward to form a blocking portion, the blocking portion being disposed corresponding to an inner surface of the limiting portion, when the blocking portion of the one second extending portion is pivoted on the first component, the blocking portion being alternatively located to a bottom of the limiting portion and a top of the limiting portion;

a pivoting assembly including a pivoting shaft and a torsion spring, the pivoting shaft passing through the two first through holes and the two second through holes, so the two first extending portions and the two second extending portions being connected by the pivoting shaft of the pivoting assembly, the pivoting assembly being flexible, and the pivoting shaft being rotatable, so each second extending portion being pivoted by the pivoting shaft of the pivoting assembly, the torsion spring being mounted around the pivoting shaft, the torsion spring being located between the two second extending portions; and a pressing element mounted on the second component;

wherein when the second component and the pressing element are in an assembling position, the blocking portion is located to the bottom of the limiting portion, and a bottom of the second component is exposed outside, after the second component and the pressing element are assembled, the second component and the pressing element are pivoted downward to a pressing position, the blocking portion passes beyond a top surface of the limiting portion to make the blocking portion located at the top surface of the limiting portion, a rear end of the second component is wrapped in the first component; and wherein when the button structure is in the pressing position, the blocking portion is unable to move downward to pass the limiting portion, so that the second component and the pressing element are limited to maintain in the pressing position.

16. A button structure, comprising:

a first component having a first base portion, two sides of the first base portion protruding outward to form two first extending portions, an inner side surface of one first extending portion protruding inward to form a limiting portion, two front ends of the two first extending portions having two first through holes transversely penetrating through the two first extending portions, a front end of a middle of the first base portion protruding frontward to form a stopping portion;

a second component pivoted on the first component, the second component having a second base portion, two sides of the second base portion protruding rearward to form two second extending portions, the two second extending portions having two second through holes transversely penetrating through the two second extending portions, the two second extending portions being located between the two first extending portions, two outer sides of the two second extending portions abutting between two inner sides of the two first extending portions, respectively, a free end of one second extending portion protruding rearward to form a blocking portion, the blocking portion being disposed corresponding to an inner surface of the limiting portion, when the blocking portion of the one second extending portion is pivoted on the first component, the blocking portion being alternatively located to a bottom of the limiting portion and a top of the limiting portion;

a pivoting assembly including a pivoting shaft and a torsion spring, the pivoting shaft passing through the two first through holes and the two second through holes, so the two first extending portions and the two second extending portions being connected by the pivoting shaft of the pivoting assembly, the pivoting assembly being flexible, and the pivoting shaft being rotatable, so each second extending portion being pivoted by the pivoting shaft of the pivoting assembly, the torsion spring being mounted around the pivoting shaft, the torsion spring being located between the two second extending portions; and a pressing element mounted on the second component;

wherein when the second component and the pressing element are in an assembling position, the blocking portion is located to the bottom of the limiting portion, and a bottom of the second component is exposed outside, after the second component and the pressing element are assembled, the second component and the pressing element are pivoted downward to a pressing position, the blocking portion passes beyond a top surface of the limiting portion to make the blocking portion located at the top surface of the limiting portion; and wherein when the button structure is in the pressing position, one end of the torsion spring abuts against lower surfaces of the two second extending portions, and the other end of the torsion spring abuts against a lower surface of the stopping portion, the blocking portion is unable to move downward to pass the limiting portion, so that the second component and the pressing element are limited to maintain in the pressing position.

17. The button structure as claimed in claim 16, wherein the stopping portion is spaced from the inner side surface of the one first extending portion to form a sliding groove between the stopping portion and the inner side surface of the one first extending portion, the limiting portion is located in the sliding groove, after the second component and the pressing element are assembled, the blocking portion projects into the sliding groove.

18. The button structure as claimed in claim 16, wherein the top surface of the limiting portion slantwise extends inward and upward, when the button structure is in the pressing position, a bottom surface of the blocking portion slantwise extends inward and upward, the bottom surface of the blocking portion is parallel with the top surface of the limiting portion.

19. The button structure as claimed in claim 18, wherein an edge of the bottom surface of the blocking portion is unrounded.

* * * * *